US009974702B2

(12) United States Patent
Gallingani

(10) Patent No.: US 9,974,702 B2
(45) Date of Patent: May 22, 2018

(54) WHEELCHAIR LIFT

(71) Applicant: Autolift S.r.l., Pegognaga-Mantova (IT)

(72) Inventor: Marco Gallingani, Castelnovo di Sotto (IT)

(73) Assignee: Autolift S.r.l., Pegognaga-Mantova (IT)

( * ) Notice: Subject to any disclaimer, the term of this patent is extended or adjusted under 35 U.S.C. 154(b) by 208 days.

(21) Appl. No.: 14/307,766

(22) Filed: Jun. 18, 2014

(65) Prior Publication Data

US 2014/0377047 A1 Dec. 25, 2014

(30) Foreign Application Priority Data

Jun. 24, 2013 (EP) ..... 13173402

(51) Int. Cl.
*A61G 3/06* (2006.01)

(52) U.S. Cl.
CPC ..... *A61G 3/062* (2013.01); *A61G 3/061* (2013.01); *A61G 3/063* (2013.01)

(58) Field of Classification Search
CPC ..... A61G 3/061; A61G 3/062; A61G 3/063
See application file for complete search history.

(56) References Cited

U.S. PATENT DOCUMENTS 4,493,603 A * 1/1985 Williams ..... A61G 3/06 414/541
4,941,799 A 7/1990 Gordon et al.
5,230,522 A 7/1993 Gehlsen et al.
5,234,311 A 8/1993 Loduha, Jr. et al.
6,464,447 B2 10/2002 Dupuy et al.
7,467,917 B2 * 12/2008 Fisher ..... A61G 3/062 414/546
7,798,761 B2 * 9/2010 Goodrich ..... A61G 3/061 318/468

(Continued)

FOREIGN PATENT DOCUMENTS

DE 203 18 186 U1 7/2004
DE 203 09 868 U1 11/2004

(Continued)

OTHER PUBLICATIONS

Letter to the European Patent Office regarding EP 13173402.2 dated Jan. 31, 2017.

(Continued)

*Primary Examiner* — Anna M Momper
*Assistant Examiner* — Ashley K Romano
(74) *Attorney, Agent, or Firm* — Collard & Roe, P.C.

(57) ABSTRACT

A wheelchair lift (1) includes a platform assembly (10) to receive a wheelchair, the platform assembly (10) being made from aluminum, a supporting assembly (20) to moveably hold the platform assembly (10), the supporting assembly (20) being made from aluminum, and a coupling device (30) to pivotably couple the platform assembly (10) to the supporting assembly (20), the coupling device (30) being made from one of steel or high strength aluminum or titanium or magnesium or combinations thereof. The platform assembly (10) includes a number of profiles (101, . . . , 107) of aluminum. The coupling device (30) is fixed to a first one of the plurality of profiles (101) of the platform assembly (10), and is pivotably coupled to the supporting assembly (20).

15 Claims, 9 Drawing Sheets

(56) References Cited

U.S. PATENT DOCUMENTS

| | | | | |
|---|---|---|---|---|
| 8,733,508 | B2 * | 5/2014 | Bacon | B66F 7/065 187/240 |
| 8,821,103 | B1 * | 9/2014 | Matthews | B60P 3/36 414/558 |
| 2006/0031984 | A1 * | 2/2006 | Takizawa | A61H 1/0266 5/86.1 |
| 2008/0101905 | A1 | 5/2008 | Morris et al. | |
| 2013/0251488 | A1 * | 9/2013 | Bruns | A61G 3/062 414/546 |

FOREIGN PATENT DOCUMENTS

| | | | |
|---|---|---|---|
| DE | 399 33 332 | T2 | 5/2007 |
| DE | 11 2005 002 470 | T5 | 9/2007 |
| EP | 0 213 521 | A1 | 3/1987 |
| EP | 0 955 029 | A2 | 11/1999 |
| EP | 3 955 029 | B1 | 9/2006 |
| EP | 1 535 592 | B1 | 2/2007 |
| EP | 2 641 576 | A1 | 9/2013 |
| JP | 2003-341408 | A | 12/2003 |
| WO | 99/60976 | A1 | 12/1999 |
| WO | 03/059685 | A2 | 7/2003 |
| WO | 2006/046876 | A1 | 5/2006 |

OTHER PUBLICATIONS

Service Manual RICON UNI-lite Personal Use Wheelchair Lift, Sep. 23, 2002, 59 pages.

Yu, Zhong qi et al. "Numerical analysis of dimension precision of U-shaped aluminium profile rotary stretch bending", Trans. Non-ferrous Met. Soc. China 17(2002), pp. 581-585.

The Aluminium Automotive Manual, "Manufacturing—Forming", 2002, 96 pages.

Molift Partner Operator Manual, Aug. 2006, 28 pages.

Molift Partner Technical Manual, Nov. 2010, 32 pages.

* cited by examiner

WHEELCHAIR LIFT

CROSS REFERENCE TO RELATED APPLICATIONS

Applicant claims priority under 35 U.S.C. § 119 of European Application No. 13173402.2 filed Jun. 24, 2013, the disclosure of which is incorporated by reference.

BACKGROUND OF THE INVENTION

Field of the Invention

The invention is directed to a wheelchair lift which enables to lift a wheelchair from a ground level position to an entry level position in a vehicle and inversely.

Description of the Related Art

Vehicular wheelchair lifts are utilized to facilitate lifting of wheelchairs into a vehicle. The wheelchair lift comprises a platform assembly having at least one plate to load a wheelchair. The platform assembly may be moved by a power control assembly among a stowed position in which the platform assembly and other components of the wheelchair are collapsed, an entry level position in which the platform assembly is in an unfolded configuration so that the wheelchair can be loaded onto the platform assembly in a vehicle and a ground level position in which the platform assembly is still unfolded and coplanar to the ground outside the vehicle.

The wheelchair lift is usually permanently mounted in the vehicle by means of a mounting assembly of the wheelchair lift which may be fixed to a floor of the vehicle. In order to avoid disturbing of driving characteristics of the vehicle, the handling of the vehicle and an increase of the fuel consumption of the vehicle, the wheelchair lift should have a low weight. On the other hand, the wheelchair lift has to be stable to load and lift a wheelchair with a person in and out of the vehicle.

There is a need to provide a wheelchair lift having a low weight and which is stable enough to load and lift a wheelchair with a person sitting in the wheelchair inside and outside of a vehicle.

SUMMARY OF THE INVENTION

An embodiment of a wheelchair lift having a low weight and being constructed in a stable manner which enables to load and lift a wheelchair is described below in accordance with the invention.

According to a possible embodiment the wheelchair lift comprises a platform assembly to receive a wheelchair, said platform assembly being made from aluminum, a supporting assembly to moveably hold the platform assembly, said supporting assembly being made from aluminum, and a coupling device to pivotably couple the platform assembly to the supporting assembly, said coupling device being made from one of steel or high strength aluminum, for example aluminum alloy 7075, or titanium or magnesium or combinations thereof. The platform assembly may comprise a plurality of profiles of aluminum. The coupling device is fixed to a first one of the plurality of profiles of the platform assembly, and the coupling device is pivotably coupled to the supporting assembly.

The platform assembly may comprise at least one plate having a platform which is pivotably coupled by means of the coupling device to the supporting assembly. The supporting assembly may comprise a first and a second holding arm. The coupling device may comprise a first pivot pin made from one of steel or high strength aluminum, for example aluminum alloy 7075, or titanium or magnesium or combinations thereof to pivotably couple the at least one plate of the platform assembly to the first holding arm, and a second pivot pin made from one of steel or high strength aluminum, for example aluminum alloy 7075, or titanium or magnesium or combinations thereof to pivotably couple the at least one plate of the platform assembly to the second holding arm. The first profile of the platform assembly may extend between the first and second holding arms. The first profile of the platform assembly may comprise a first end section being arranged proximal to the first holding arm and distal to the second holding arm, and a second end section being arranged proximal to the second holding arm and distal to the first holding arm. The first pivot pin may be fixed to the first end section of the first profile of the platform assembly and the first holding arm may pivotably coupled to the first pivot pin. The second pivot pin may be fixed to the second end section of the first profile of the platform assembly and the second holding arm may pivotably coupled to the second pivot pin.

The first and second end section of the first profile of the platform assembly may respectively include a cavity. According to a possible embodiment of the wheelchair lift the first pivot pin may be screwed in the cavity of the first end section of the first profile, and the second pivot pin may be screwed in the cavity of the second end section of the first profile. According to another possible embodiment of the wheelchair lift the first pivot pin may be glued in the cavity of the first end section of the first profile, and the second pivot pin may be glued in the cavity of the second end section of the first profile.

According to another embodiment, the coupling device is configured as a bar made from one of steel or high strength aluminum, for example aluminum alloy 7075, or titanium or magnesium or combinations thereof to pivotably couple the at least one plate of the platform assembly to the first and second holding arm. The coupling device may be formed as an end-to-end bar which is disposed in the cavity of the first profile. The bar may be inserted and fixed in a cavity of the first profile of the platform assembly. A first end section of the bar may protrude from the first end section of the first profile and a second end section of the bar may protrude from the second end section of the first profile. The first holding arm may pivotably coupled to the first end section of the bar and the second holding arm may pivotably coupled to the second end section of the holding arm.

The at least one plate of the platform assembly may comprise an end being closer to the supporting device than other sides/ends of the at least one plate. The first profile of the platform assembly may be arranged at this end of the at least one plate of the platform assembly being proximal to the supporting device. The first profile of the platform assembly may extend along this end/side of the at least one plate of the platform assembly. The first profile may be formed by an extrusion process or by a laser cutting process. The first profile may be welded to other profile of the platform assembly. The first profile may, for example, be formed as a hollow tube.

According to another embodiment of the wheelchair lift the platform assembly may comprise the at least one plate having a platform and first and second side panels arranged at different sides of the at least one plate. The whole platform assembly may be made of the plurality of profiles of aluminum.

According to another embodiment of the wheelchair lift the platform assembly may comprise an inner plate, an outer plate and a hinge unit. Both of the inner and outer plates are configured to support the wheelchair. The inner and outer plate may be configured to be collapsible by means of the hinge unit. The hinge unit may be arranged at a bottom side of the respective platform of the inner and outer plate of platform assembly between the inner and outer plate. The inner and outer plate respectively comprise a platform, a first side panel and a second side panel.

The whole platform assembly comprising the first and the second plate may be made of aluminum. The respective platforms of the inner and outer plates of the platform assembly may be made of at least a second one of the plurality of profiles of the platform assembly. The respective first side panel may be made of at least a third one of the plurality of profiles of the platform assembly, and the respective second side panel may be made of at least a fourth one of the plurality of profiles of the platform assembly. The hinge unit may be made of at least a fifth one of the plurality of profiles of the platform assembly. The profiles may be made by an extrusion process or a laser cutting process and may be welded together, for example by a laser welding process.

The wheelchair lift may further comprise a lifting assembly being connected to a power control assembly and the supporting assembly, and a mounting assembly to mount the wheelchair lift on a floor of the vehicle. In addition to the platform assembly and the supporting assembly with the first and second holding arm the lifting assembly and the mounting assembly may be made from aluminum. The platform assembly, the supporting assembly and the lifting assembly may be composed of profiles/bars of aluminum made by an extrusion process or a laser cutting process. The profiles of the platform assembly, the supporting assembly and the lifting assembly may be made from aluminum alloy 6000/7000.

Since the main components of the wheelchair lift are made from aluminum, the wheelchair lift has a low weight and is not endangered by corrosion. The extrusion or laser cutting process to manufacture the different profiles of aluminum for the platform assembly, the first and second holding arm of the supporting assembly and the lifting assembly enable to construct the wheelchair lift in a cost-saving manner and with large creative freedom regarding the shape of the different components of the wheelchair lift. The use of a coupling device comprising a bar or pivot pins made from one of steel or high strength aluminum or titanium or magnesium or combinations thereof which are fixed to one of the aluminum profiles of the platform assembly enable to ensure that the wheelchair lift may be stable to load and lift a wheelchair.

BRIEF DESCRIPTION OF THE DRAWINGS

It is to be understood that both the foregoing general description and the following detailed description present embodiments and are intended to provide an overview or a framework for understanding the nature and character of the disclosure. The accompanying drawings are included to provide a further understanding, and are incorporated into and constitute a part of this specification. The drawings illustrate various embodiments and, together with the description, serve to explain the principles and operation of the concepts disclosed.

FIG. 6 shows an embodiment of a profile made from aluminum for fixing a coupling device to pivotably couple a platform assembly to a supporting assembly of the wheelchair lift.

DETAILED DESCRIPTION OF PREFERRED EMBODIMENTS

Figure 1:
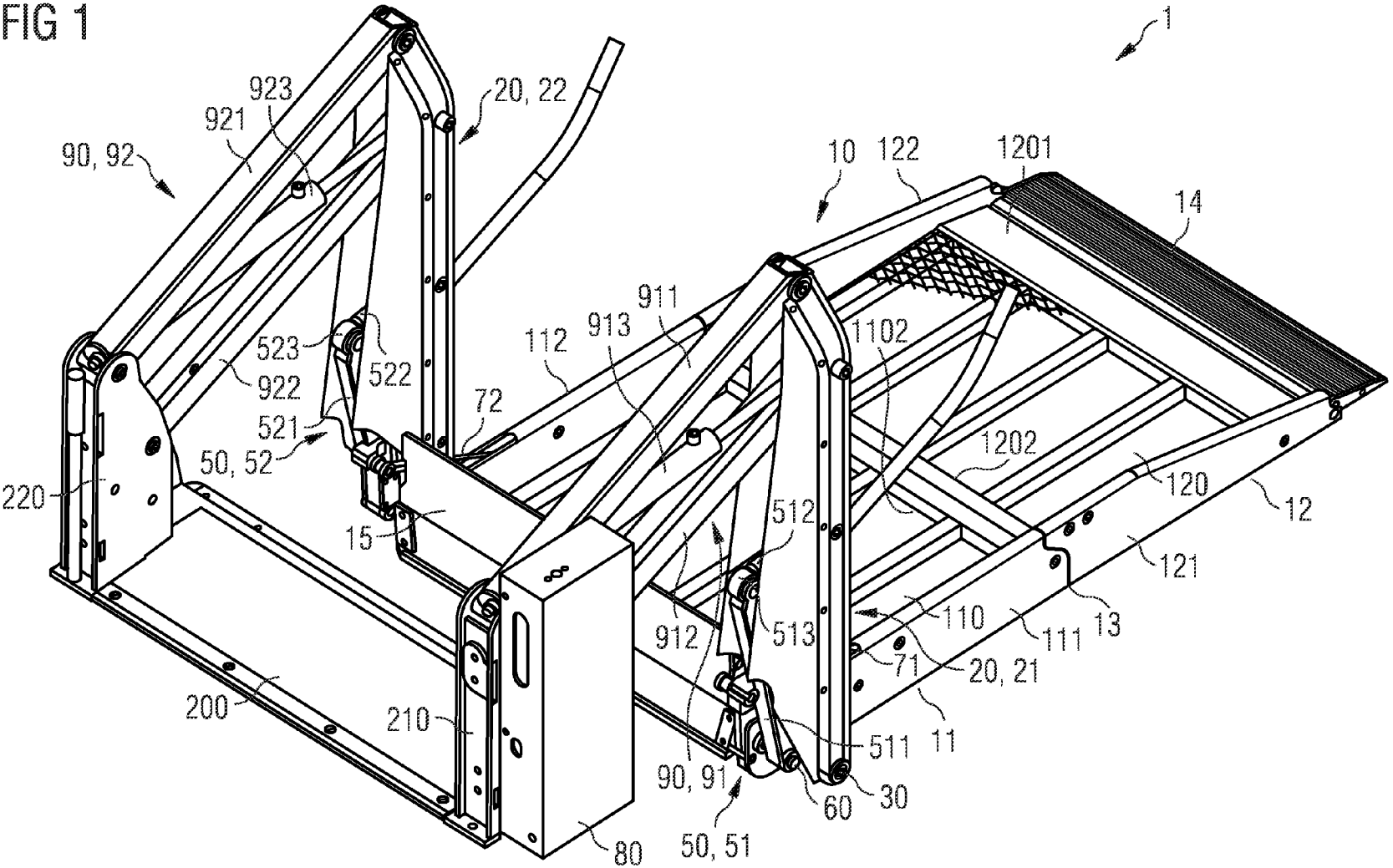
FIG. 1 shows an embodiment of a wheelchair lift with a lifting assembly, a supporting assembly and a platform assembly made of aluminum.

FIG. 1 shows an embodiment of a wheelchair lift 1 to raise a wheelchair from a ground level into a vehicle. The wheelchair lift comprises a platform assembly 10 to receive and load the wheelchair. The platform assembly 10 comprises a plurality of profiles made from aluminum. The platform assembly comprises at least one plate having a platform to support the wheelchair and a first and second side panel. The side panels may be arranged at different sides of the platform. The platform assembly may comprise a single plate being constructed as a component in one piece.

In the exemplified embodiment of the wheelchair lift 1 illustrated in FIG. 1 the platform assembly 10 comprises an inner plate 11 and an outer plate 12. The inner plate 11 may comprise a platform 110 to support the wheelchair and side panels 111, 112 for preventing the wheelchair from rolling off the sides of the platform 110. The outer plate 12 may comprise a platform 120 to load the wheelchair and side panels 121, 122 for preventing the wheelchair from rolling off the sides of the outer plate 12. The outer and inner plates are pivotably coupled by a hinge unit 13 which is arranged at the bottom side of the platform assembly 10 between the inner and outer plate.

The inner plate 11 has an end 1101 distal to the hinge unit 13 and an end 1102 proximal to the hinge unit 13. The outer plate 12 has an end 1201 distal to the hinge unit 13 and an end 1202 proximal to the hinge unit 13. An outer roll stop means 14 is mounted to the end 1201 of the outer plate 13, and an inner roll stop means 15 is mounted to the end 1101 of the inner plate 11. In a retracted position of the roll stop means 14, 15 the roll stop means prevent a wheelchair from rolling-off the front end and back end of the platform assembly when the platform assembly is lowered from the entry level position to the ground level position. The roll stop means 14 may be hinged down in the ground level position so that a wheelchair can roll-off or enter the platform assembly. The roll stop means 15 may be hinged down in the entry level position so that a wheelchair can roll-off or enter the platform assembly, for example, in a vehicle.

Figure 2:
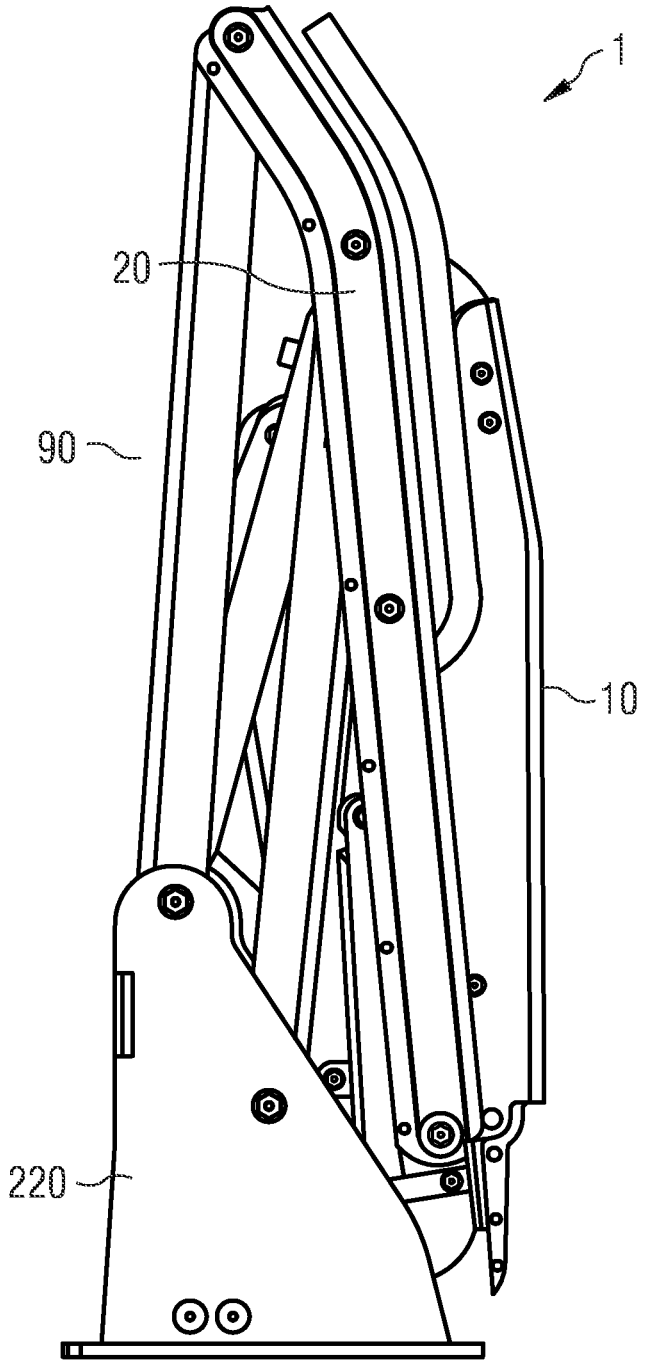
FIG. 2 shows an embodiment of a wheelchair lift in a folded configuration.

The wheelchair lift further comprises a power control assembly 80 to control a movement of the platform assembly 10 among a stowed position in which the inner and outer plates 11, 12 of the platform assembly are collapsed as shown in FIG. 2, an entry level position in which the inner and outer plates 11, 12 of the platform assembly are in an unfolded configuration and a ground level position in which the inner and outer plates 11, 12 of the platform assembly are unfolded and are moved to a level below the entry level.

The wheelchair lift further comprises a supporting assembly 20 to moveably hold the platform assembly 10, and a lifting assembly 90 to lift and lower the supporting assembly 20. The supporting assembly 20 and the lifting assembly 90 are made from aluminum. The lifting assembly 90 comprises parallelogram actuating linkage structure 91 and a parallelogram actuating linkage structure 92. Each of the parallelogram actuating linkage structures 91, 92 have a top actuating arm 911, 921 and a bottom actuating arm 912, 922 which are located substantially parallel to each other. The respective top actuating arms 911, 921 and the respective bottom actuating arms 912, 922 may be coupled by a respective hydraulic cylinder 913, 923.

A respective rear end of the top actuating arms 911, 921 is pivotably coupled to a bearing unit 210, and a respective rear end of the bottom actuating arms 912, 922 is pivotably coupled to a bearing unit 220. The bearing unit 210 is coupled to the power control assembly 80 to control a movement of the platform assembly. The wheelchair lift further comprises a mounting assembly 200 to mount the wheelchair lift 1 on a floor, for example a floor inside a vehicle. The mounting assembly may comprise a mounting plate 200 which may be fixed by screws to the floor of a vehicle. The mounting assembly, especially the mounting plate, may be made of aluminum.

The supporting assembly 20 comprises a holding arm 21 and a holding arm 22 being arranged in a distance to each other. Each of the holding arms 21, 22 comprises an upper and a lower portion which may be formed as a unique part. The respective upper portion of the holding arms 21, 22 is pivotably coupled to the lifting assembly 90. The respective lower portion of the holding arms 21, 22 which is formed as a substantially vertical arm is pivotably coupled to the platform assembly 10, particularly to the inner plate 11 of the platform assembly 10. The holding arms 21, 22 may pivotably coupled to the platform assembly 10 by a coupling device 30.

The coupling device 30 is configured to pivotably couple the platform assembly 10, particularly the inner plate 11 of the platform assembly 10, to the supporting assembly 20. The coupling device 30 can be made from one of steel or high strength aluminum, such as aluminum alloy 7075, or titanium or magnesium or combinations thereof. The coupling device 30 may be fixed to the platform assembly 10 and the supporting assembly 20 may pivotably coupled to the coupling device 30. According to another embodiment the coupling device 30 may be fixed to the supporting assembly 20 and the platform assembly 10 may pivotably coupled to the coupling device 30. The coupling device 30 forms a rotational axis for the inner plate 11 or the holding arms 21, 22 of the supporting assembly 20.

The wheelchair lift comprises an elbow assembly 50 comprising an elbow device 51 and an elbow device 52. The elbow devices 51, 52 respectively comprise a first arm 511, 521 coupled to the inner plate 11, a second arm 512, 522 coupled to the supporting assembly 20, and a hinge element 513, 523 at which the respective first arm 511, 521 and the respective second arm 512, 522 are pivotably connected. The elbow device 51, particularly the arm 511 of the elbow device 51, is pivotably coupled to the side panel 111 of the inner plate 11 by a coupling device 60. The elbow device 52, particularly the arm 521 of the elbow device 52, is pivotably coupled to the side panel 112 of the inner plate 11 by another coupling device 60. The coupling devices 60 can be made from one of steel or high strength aluminum, for example aluminum alloy 7075, or titanium or magnesium or combinations thereof.

The wheelchair lift further comprises a linkage device 71 being arranged between the platform assembly 10 and the elbow device 51, and a linkage device 72 being arranged between the platform assembly 10 and the elbow device 52. The linkage devices 71, 72 may comprise a steel rope or a chain or some rigid elements. The rigid elements may be formed as rods. The rigid elements may pivotably be connected by hinge elements. The linkage devices 71, 72 are partially guided inside the side panels 111, 112. A respective one of the ends of the linkage devices 71, 72 may be coupled to the outer plate 12. A respective other one of the ends of the linkage devices 71, 72 may be coupled to the respective arm 511, 521 of the elbow devices 51, 52.

FIG. 2 shows the wheelchair lift 1 in a folded/stowed configuration in which the inner and outer plates of the platform assembly as well as the other components of the wheelchair lift, such as the holding arms of the supporting assembly 20 and the lifting assembly 90 are folded together. The bottom surfaces of the inner and outer plates 11, 12 abut each other.

Figure 3:
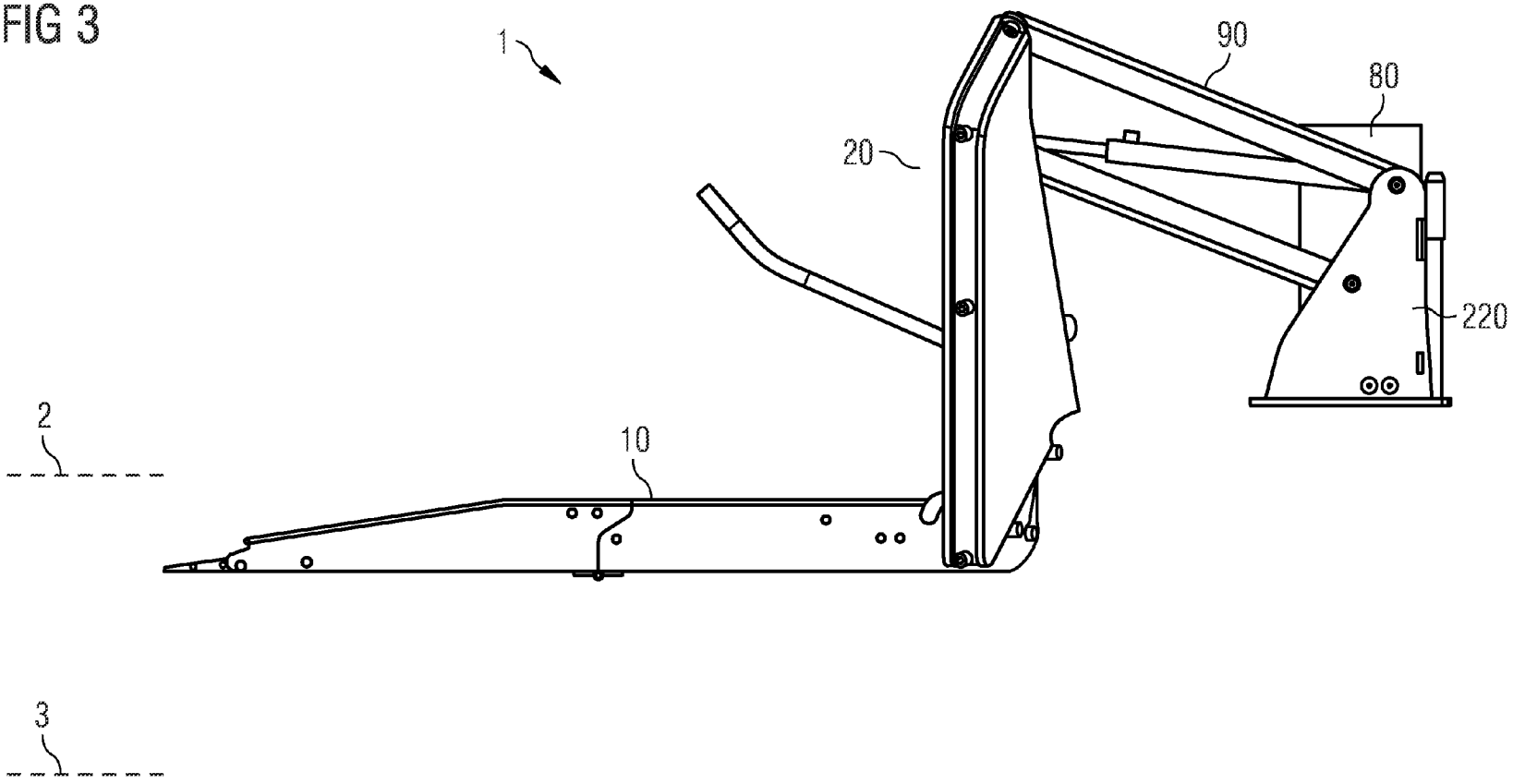
FIG. 3 shows an embodiment of a wheelchair lift with an unfolded platform assembly between an entry level position and a ground level position.

FIG. 3 shows the wheelchair lift 1 in an unfolded configuration between the entry level position 2, for example inside of a vehicle, to load/unload a wheelchair onto the inner and outer plates of the platform assembly 10 and the ground level position 3, for example the level outside the vehicle, to load/unload the wheelchair onto the inner and outer plates of the platform assembly. In the entry level position the inner and outer plates 11, 12 are unfolded and the upper surfaces of the platforms 110, 120 forms a continuous area to contact a floor, for example a floor in a vehicle, to receive the wheelchair.

In order to unfold the wheelchair lift from the stowed configuration to the unfolded configuration in the entry level position, the power control assembly 80 moves the lifting assembly 90 such that the arms 912, 922 of the parallelogram actuating linkage structures 91, 92 decline from the vertical position shown in FIG. 2 to a substantially horizontal position. The lower arm 911, 921 of the parallelogram actuating linkage structures 91, 92 are pressed to the elbow devices 51, 52 and particularly to the hinge elements 513, 523 so that the angle between the upper and lower arms 512, 522 and 511, 521 of the elbow devices 51, 52 changes. The respective lower arm 511, 521 of the elbow devices 51, 52 which is coupled to the end 1101 of the inner plate 11 pushes against the end 1101 of the inner plate 11 which causes that the inner plate 11 is swung down around a rotational axis formed by the coupling device 30 at which the inner plate is pivotably coupled to the holding arms 21, 22. The inner plate 11 of the platform assembly 10 declines and causes an unfolding of the inner and outer plates 11, 12. The inner and outer plates 11, 12 of the platform assembly swing open until the entry level position 2 shown in FIG. 3 is reached.

In order to put down the wheelchair to the ground level position 3, for example outside a vehicle, the power control assembly 80 slants the lifting assembly 90 anymore so that the unfolded platform assembly 10 is moved by the supporting assembly 20 from the entry level position 2 to the ground level position 3 which is below the entry level position as shown in FIG. 3.

The linkage devices 71, 72 facilitate the swing-down deployment motion of the inner and outer plates 11, 12. In the stowed configuration of the wheelchair lift the linkage devices 71, 72 are loosely guided between the elbow devices 51, 52 and the outer plate 12. During the swinging-down movement of the platform assembly the linkage devices 71, 72 are strained so that the linkage devices enable a low and continuous movement of the inner and outer plates 11, 12 during the unfolding procedure.

Figure 4:
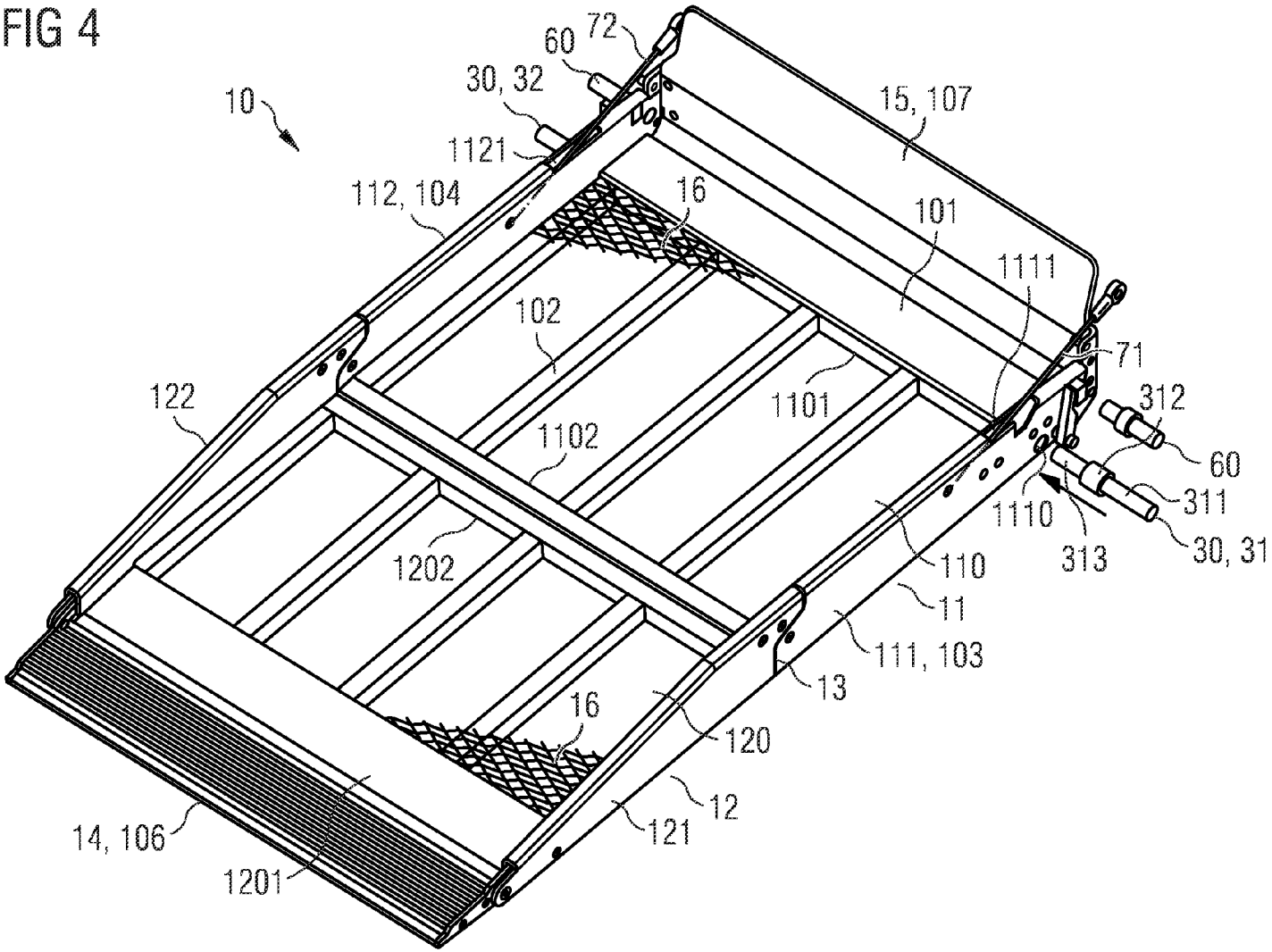
FIG. 4 shows an embodiment of a platform assembly made of aluminum and a coupling device to pivotably couple the platform assembly to holding arms of a supporting assembly.

FIG. 4 shows an embodiment of the platform assembly 10 of the wheelchair lift 1. The platform assembly 10 is configured in a two-piece embodiment comprising the inner plate 11 and the outer plate 12 to support the wheelchair. The inner plate 11 comprises the platform 110 and side panels 111, 112 arranged at both sides of the platform 110. The outer plate 12 comprises the platform 120 and the side panels 121, 122 arranged at both sides of the platform 120. The outer plate 12 is pivotably coupled to the inner plate 11 by the hinge unit 13 arranged at the bottom side of the platform assembly 10. The inner plate 11 is pivotably coupled to the supporting assembly 20 shown in FIG. 1 by the coupling device 30.

The platform assembly is made from aluminum. The platform assembly 10 may comprise a plurality of profiles 101, . . . , 107 of aluminum. The profiles may be configured as hollow profiles, such as hollow bars. The hollow profiles may include inner strut members to strengthen the profiles. The profiles may be formed by an extrusion or a laser cutting process. According to a possible embodiment, the inner plate 11 and the outer plate 12 may be formed by profiles 102, 103 and 104 of aluminum. The profile 102 may be formed as a hollow bar to form the respective platform 110, 120 of the inner and outer plate 11, 12. The profile 103 of aluminum forms the side panels 111, 121 of the inner and outer plates 11, 12, and the profile 104 of aluminum forms the side panels 112, 122 of the inner and outer plates 11, 12. The profiles 103 and 104 which forms the side panels 121 and 122 may be belately formed with the slanted front edge shown in FIG. 4. The outer roll stop means 14 may be formed by a profile 106 of aluminum, and the roll stop means 15 may be formed by a profile 107 of aluminum. The profiles may be welded together to form the platform assembly 10.

The coupling device 30 is configured to pivotably couple the platform assembly 10, particularly the inner plate 110, to the supporting assembly 20. The coupling device 30 is fixed to the inner plate 11 and pivotably coupled to the supporting assembly 20. The coupling device 30 may be made from one of steel or high strength aluminum, for example aluminum alloy 7075, or titanium or magnesium or combinations thereof which enables a secure and stable coupling between the platform assembly 10 made from aluminum and the supporting assembly 20 made from aluminum. In order to fix the coupling device 30 to the inner plate 11 of the platform assembly 10, the platform assembly 10 comprises a profile 101 of aluminum. The profile 101 of the platform assembly 10 is disposed at the end 1101 of the platform 110 of the inner plate 11 between the side panels 111, 112 of the inner plate 11.

In order to securely and firmly connect the coupling device 30 with the platform assembly 10, the coupling device 30 is fixed to the profile 101 of the platform assembly 10. The coupling device 30 may comprise a pivot pin 31 made from one of steel or high strength aluminum, for example aluminum alloy 7075, or titanium or magnesium or combinations thereof to pivotably couple the platform assembly 10 to the holding arm 21 and a pivot pin 32 made from one of steel or high strength aluminum, for example aluminum alloy 7075, or titanium or magnesium or combinations thereof to pivotably couple the platform assembly 10 to the holding arm 22. According to another embodiment the coupling device 30 may be configured as a bar made from one of steel or high strength aluminum, for example aluminum alloy 7075, or titanium or magnesium or combinations thereof to pivotably couple the platform assembly 10 to the holding arms 21, 22.

The coupling device 60 may comprise a pivot pin 61 made from one of steel or high strength aluminum, for example aluminum alloy 7075, or titanium or magnesium or combinations thereof and a pivot pin 62 made from one of steel or high strength aluminum, for example aluminum alloy 7075, or titanium or magnesium or combinations thereof. The pivot pin 61 of the coupling device 60 is configured to pivotably couple the inner plate 11 to the arm 511 of the elbow device 51. The pivot pin 62 of the coupling device 60 is configured to pivotably couple the inner plate 11 to the first arm 521 of the elbow device 52. The pivot pin 61 may be screwed in or glued on the side panel 111 of the inner plate 11. The pivot pin 62 may be screwed in or glued on the side panel 112 of the inner plate 11. According to another embodiment the coupling device 60 may be configured as a bar made from one of steel or high strength aluminum, for example aluminum alloy 7075, or titanium or magnesium or combinations thereof to pivotably couple the inner plate 11 of the platform assembly 10 to the arm 511 of the elbow device 51 and the arm 521 of the elbow device 52.

Figure 5A:
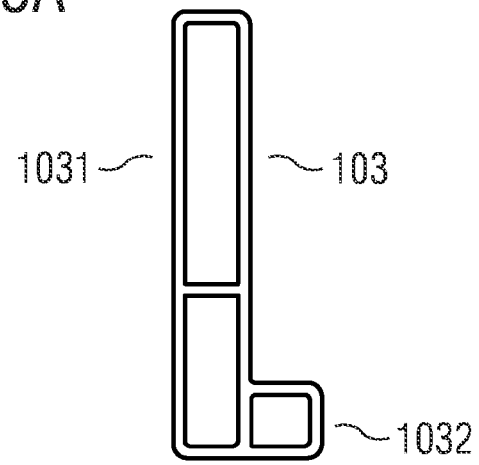
FIG. 5A shows an embodiment of a profile made from aluminum of a platform assembly of a wheelchair lift.
Figure 5B:
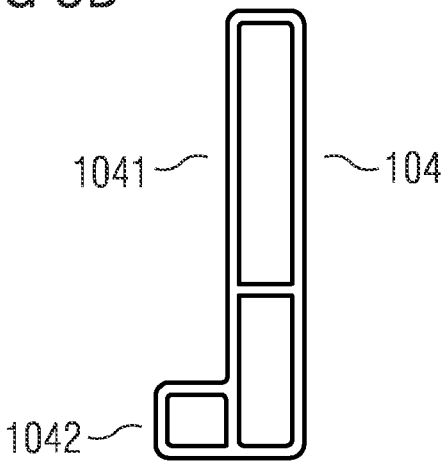
FIG. 5B shows an embodiment of another profile made from aluminum of a platform assembly of a wheelchair lift.
Figure 5C:
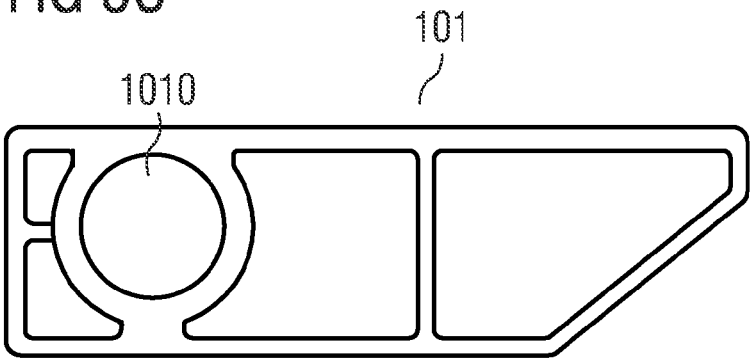

FIG. 5A shows a cross section of the profile 103 of the side panel 111, and FIG. 5B shows a cross section of the profile 104 of the side panel 112. Each of the side panels 111 and 112 may be made of a hollow profile. The profiles 103, 104 are made of aluminum and may be formed by an extrusion or a laser cutting process. Each of the profiles comprises a vertical part 1031, 1041 forming the actual side panel and a horizontal part 1032, 1042 being configured to support a tread 16 to load the wheelchair. The tread 16 to load the wheelchair may be formed as a grating of aluminum.

FIG. 6 shows a cross section of the profile 101 to fix the coupling device 30, for example the pivot pins 31, 32, to the platform assembly 10. The profile 101 is made from aluminum and may be formed by an extrusion process. The profile is formed as a hollow profile comprising a plurality of bars or strut elements. The profile 101 comprises a fixing element 1010 to fix the coupling device 30, for example the pivot pins 31, 32, to the platform assembly 10. The fixing element 1010 may be configured as a cavity. The coupling device 30 is fixed into the cavity of the profile 101.

Figure 7:
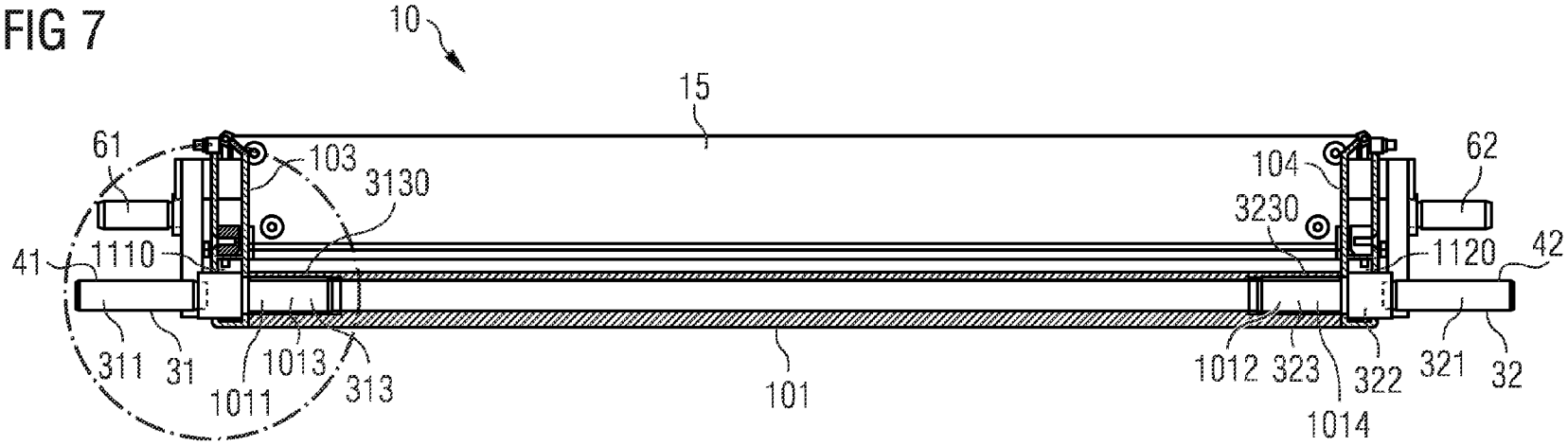
FIG. 7 shows an embodiment of a platform assembly with a profile made from aluminum for fixing a coupling device to pivotably couple a platform assembly to a supporting assembly of a wheelchair lift.
Figure 8:
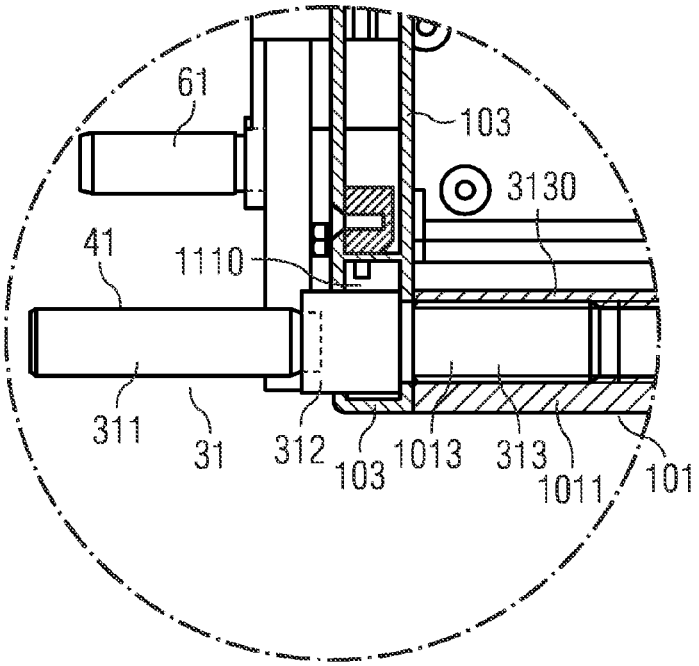
FIG. 8 shows an enlarged view of an embodiment of a platform assembly with a profile made of aluminum for fixing a coupling device to pivotably couple a platform assembly to a supporting assembly of a wheelchair lift.

FIG. 7 shows a cross section of the platform assembly 10 from a backside of the wheelchair lift with the roll stop means 15. FIG. 8 shows an area illustrated as an encircled zone in FIG. 7 in an enlarged view. The profile 101 of the platform assembly 10 extends between the holding arms 21, 22 and may comprise an end section 1011 being arranged proximal to the holding arm 21 and distal to the holding arm 22, and an end section 1012 being arranged proximal to the holding arm 22 and distal to the holding arm 21. The pivot pin 31 is fixed to the end section 1011 of the profile 101 of the platform assembly 10 and the pivot pin 32 is fixed to the end section 1012 of the profile 101 of the platform assembly 10.

The end sections 1011, 1012 of the profile 101 of the platform assembly 10 may include a respective cavity 1013, 1014. According to a possible embodiment of the wheelchair lift the pivot pin 31 is screwed in the cavity 1013 of the end section 1011 of the profile 101 of the platform assembly 10, and the pivot pin 32 is screwed in the cavity 1014 of the end section 1012 of the profile 101 of the platform assembly 10. According to another embodiment of the wheelchair lift the pivot pin 31 is glued in the cavity 1013 of the end section 1011 of the profile 101 of the platform assembly 10, and the pivot pin 32 is glued in the cavity 1014 of the end section 1012 of the profile 101 of the platform assembly 10.

According to another embodiment of the wheelchair lift each of the pivot pins 31, 32 has a first portion 311, 321, a second portion 312, 322 and a third portion 313, 323. The respective second portion 312, 322 is arranged between the respective first portion 311, 321 and the respective third portion 313, 323. The respective second portion 312, 322 of each of the pivot pins 31, 32 has a larger diameter than the respective first portion 311, 321 and the respective third portion 313, 323 of each of the pivot pins 31, 32. The first portion 311 of the pivot pin 31 is pivotably coupled to the holding arm 21. The first portion 321 of the pivot pin 32 is pivotably coupled to the holding arm 22.

According to a possible embodiment of the wheelchair lift, the wheelchair lift may comprise a first bushing element 41 and a second bushing element 42. The first bushing element 41 may be arranged between the holding arm 21 and the first portion 311 of the pivot pin 31. The bushing element 41 enables that the pivot pin 31 and the holding arm 21 are pivotably coupled without any friction there between. The bushing element 42 may be arranged between the holding arm 22 and the first portion 321 of the pivot pin 32. The bushing element 42 enables that the pivot pin 32 and the holding arm 22 are pivotably coupled without any friction there between.

According to an embodiment of the wheelchair lift the third portion 313 of the pivot pin 31 is formed with a thread 3130 to screw the third portion 313 of the pivot pin 31 in the cavity 1013 of the end section 1011 of the profile 101 of the platform assembly 10. The third portion 323 of the pivot pin 32 may also formed with a thread 3230 to screw the third portion 323 of the pivot pin 32 in the cavity 1014 of the end section 1012 of the profile 101 of the platform assembly 10.

According to another embodiment of the wheelchair lift the third portion 313 of the pivot pin 31 may be glued in the cavity 1013 of the end section 1011 of the profile 101 of the platform assembly. The third portion 323 of the pivot pin 32 may be glued in the cavity 1014 of the end section 1012 of the profile 101 of the platform assembly 10.

According to a possible embodiment of the wheelchair lift the side panel 111 may include a hole 1110. The pivot pin 31 may be inserted in the hole 1110 of the side panel 111 such that the second portion 312 of the pivot pin 31 is disposed in the hole 1110 of the side panel 111. The side panel 112 may include a hole 1120, and the pivot pin 32 may be inserted in the hole 1120 of the side panel 122 such that the second portion 322 of the pivot pin 32 is disposed in the hole 1120 of the side panel 122.

Figure 9:
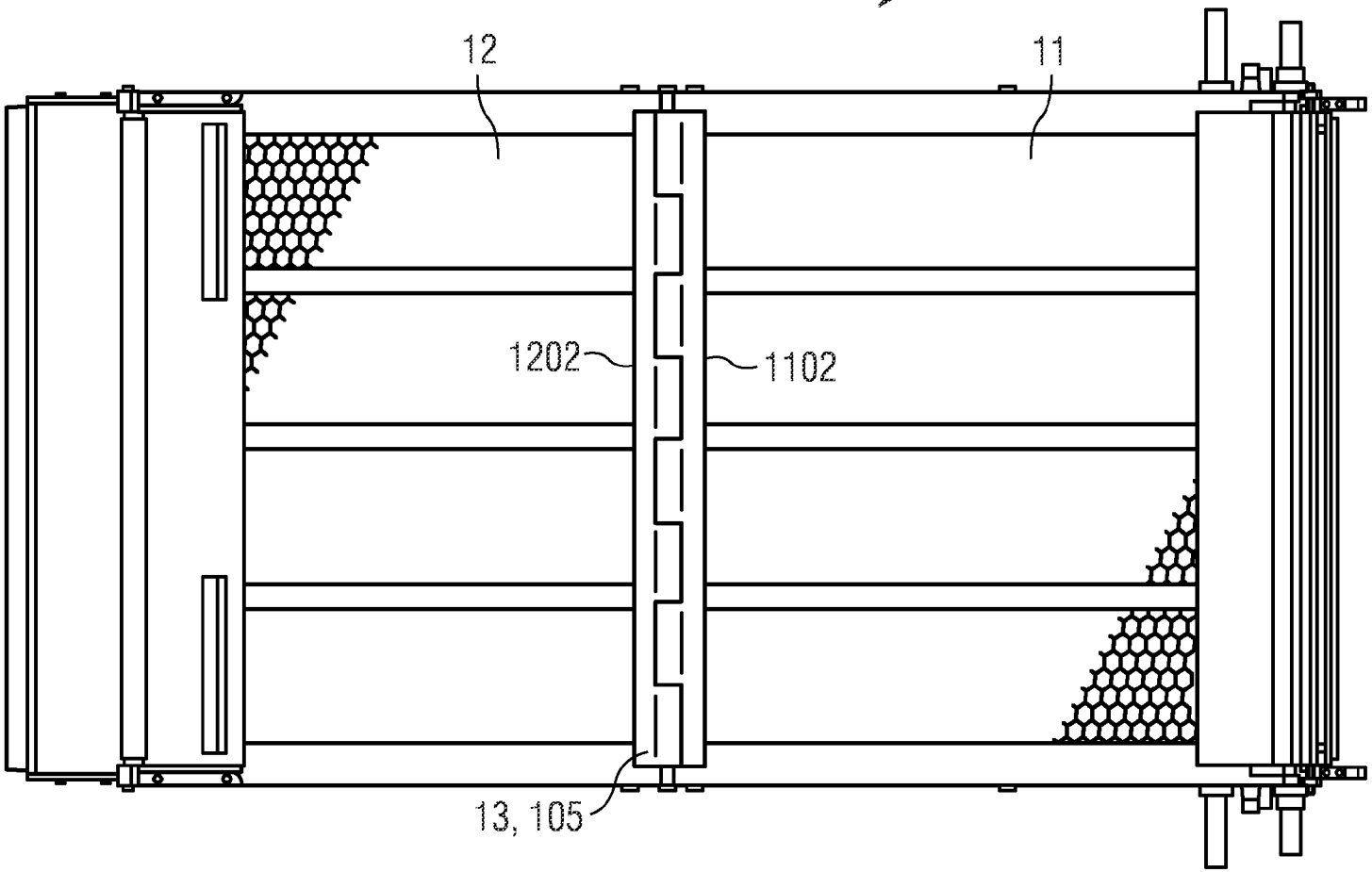
FIG. 9 shows an embodiment of a platform assembly made from aluminum with an inner and outer plate coupled by a hinge unit of a wheelchair lift.

FIG. 9 shows rear side of the platform assembly 10 comprising the inner plate 11 and the outer plate 12. The inner and the outer plate are foldably coupled by the hinge unit 13. The hinge unit 13 may be made from aluminum, and may be formed as a profile which is made by an extrusion process. The hinge unit 13 is fixed to the end 1102 of the inner plate 11 and the end 1201 of the outer plate 12.

Figure 10:
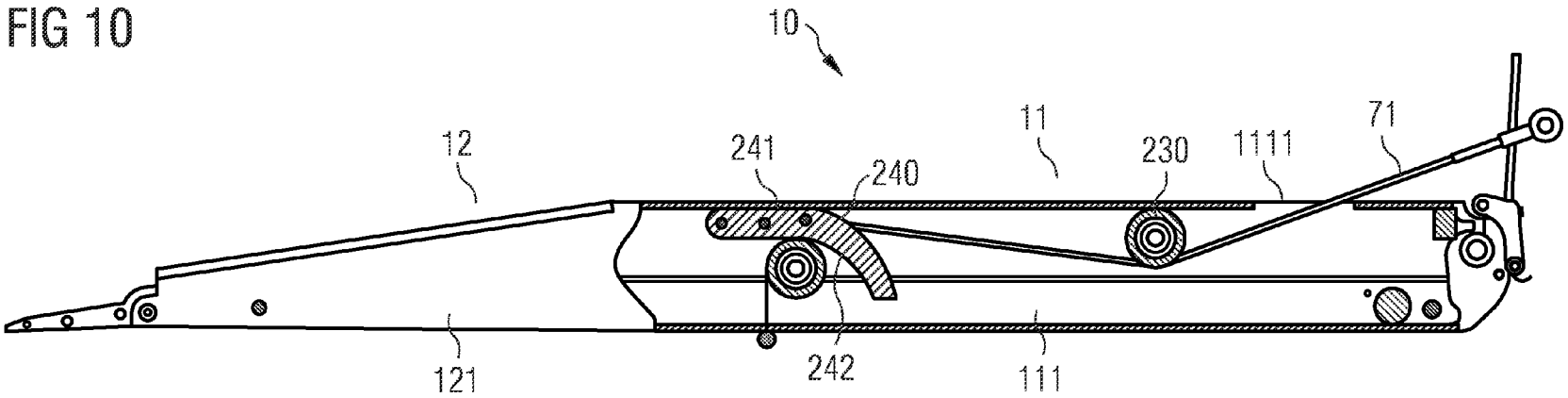
FIG. 10 shows an embodiment of a platform assembly made of aluminum with a linkage assembly of a wheelchair lift.

FIG. 10 shows an embodiment of the platform assembly 10 made from aluminum with a linkage device 71. FIG. 10 shows only the linkage device 71 guided within the side panels 111, 121 of the inner and outer plate 11, 12. The linkage device 72 is guided in the same manner within the side panels 112 and 122 of the inner and outer plate 11, 12. The side panels 111, 112 of the inner plate 11 respectively have an opening 1111, 1121. The linkage device 71 is guided from the arm 511 of the elbow device 51 through the opening 1111 of the side panel 111 of the inner plate 11 inside the side panel 111 of the inner plate 11 and covered by the side panel 111 of the inner plate 11 to the outer plate 12. An end of the linkage assembly 71 may be fixed to the outer plate 12 of the platform assembly, for example to the side panel 121, and the other end of the linkage device 71 may be fixed to the arm 511 of the elbow device 51. The linkage device 72 is guided from the arm 521 of the elbow device 52 through the opening 1121 of the side panel 112 of the inner plate 11 inside the side panel 112 of the inner plate 11 and covered by the side panel 112 of the inner plate 11 to the outer plate 12. An end of the linkage assembly 72 may be fixed to the outer plate 12 of the platform assembly 10, for example to the side panel 122, and the other end of the linkage device 72 may be fixed to the arm 521 of the elbow device 52.

The wheelchair lift may comprise a first deflection unit 230 to deflect the linkage device 71 inside the side panel 111 to the side panel 121 of the outer plate 12. The first deflection unit 230 may be disposed inside the side panel 111. The linkage device 72 is deflected in the same manner by a second deflecting unit 230 disposed inside the side panel 112 to the side panel 122 of the outer plate 12. The first and second deflecting units 230 may be formed as a pulley.

The wheelchair lift may further comprise a first and second arrestor element 240. A first part 241 of the first arrestor element 240 is movably connected inside the side panel 121 of the outer plate 12. A first part 241 of second arrestor element 240 is movably connected inside the side panel 122 of the outer plate 12. In the stowed configuration of the platform assembly the second part of the first arrestor element abuts on the holding arm 21 and the second part of the second arrestor element abuts on the holding arm 22 so that the foldable platform assembly is firmly held at the holding arms of the supporting assembly 20 in the stowed configuration of the wheelchair lift. In the unfolded configuration the respective first and second parts 241, 242 of the arrestor element 240 are covered inside the side panels 111, 112 or 121, 122.

The wheelchair lift 1 is shown in the FIGS. 1 to 4 and 9 and 10 with a foldable platform assembly 10 comprising the inner and outer plate 11, 12. The wheelchair lift may also be provided with a single, one-piece platform or a split platform which is separated along a longitudinal direction, wherein one half of the split platform swings towards the holding arm 21 and the other half of the split platform swings towards the holding arm 22 when the wheelchair lift is moved from the entry position to the stowed configuration. The coupling device 30 may also be used to pivotably couple the single, one-piece platform or the split platform to the supporting assembly 20.

The wheelchair lift may be used to lift any load or may operate without being operated with a load. Furthermore, the wheelchair lift can be mounted to any location where it can be moved from the stowed to the unfolded configuration which does not necessarily require mounting to a vehicle.

Many modifications and other embodiments set forth herein will come to mind to one skilled in the art to which the embodiments pertain having the benefit of the teachings presented in the foregoing descriptions and the associated drawings. Therefore, it is to be understood that the description and the claims are not to be limited to the specific embodiments disclosed and that modifications and other embodiments are intended to be included within the scope of the appended claims. It is intended that embodiments cover the modifications and variations of the embodiments provided they come within the scope of the appended claims and their equivalents. Although specific terms are employed herein, they are used in a generic and descriptive sense only and not for purposes of limitation.

LIST OF REFERENCES

1 wheelchair lift
2 entry level position
3 ground level position
10 platform assembly
11 inner plate of the platform assembly
12 outer plate of the platform assembly
13 hinge unit
14, 15 roll stop means
110 platform
111, 112 side panel
120 platform
121, 122 side panel
20 supporting assembly
21, 22 holding arms
30 coupling device
31, 32 pivot pin
41, 42 bushing element
50 elbow assembly
51, 52 elbow device
60 coupling device
61, 62 pivot pin
70 linkage assembly
71, 72 linkage device
80 power control assembly
90 lifting assembly
200 mounting assembly
210, 220 bearing unit
230 deflection unit
240 arrestor element

What is claimed is:

1. A wheelchair lift, comprising:

a platform assembly (10) to receive a wheelchair, said platform assembly (10) being made from aluminum, a supporting assembly (20) to moveably hold the platform assembly (10), said supporting assembly (20) being made from aluminum and comprising a first holding arm and a second holding arm (21, 22) arranged at a distance to each other, a coupling device (30) to pivotably couple the platform assembly (10) to the supporting assembly (20), said coupling device (30) being made from one of steel or high strength aluminum or titanium or magnesium or combinations thereof, wherein the platform assembly (10) comprises a plurality of profiles (101, . . . , 107) of aluminum, wherein at least a first one of the plurality of profiles (101) is formed as a hollow tube, the hollow tube extending along a side of the platform assembly (10) proximal to the supporting assembly (20) between the first holding arm and the second holding arm (21, 22) of the supporting assembly (20), and the hollow tube having a cavity (1013, 1014) included in an end section (1011, 1012) of the hollow tube of the at least first one of the plurality of profiles (101), wherein the coupling device (30) is fixed into the cavity (1013, 1014) of the hollow tube so that a portion (313) of the coupling device (30) is completely surrounded by the hollow tube to strengthen the coupling of the platform assembly (10) and the supporting assembly (20), wherein the coupling device (30) is pivotably coupled to the supporting assembly (20).

2. The wheelchair lift as claimed in claim 1, wherein the supporting assembly (20) comprises a first and a second holding arm (21, 22) being arranged in a distance to each other, wherein the coupling device (30) comprises a first pivot pin (31) made from one of steel or high strength aluminum or titanium or magnesium or combinations thereof to pivotably couple the platform assembly (10) to the first holding arm (21) and a second pivot pin (32) made from one of steel or high strength aluminum or titanium or magnesium or combinations thereof to pivotably couple the platform assembly (10) to the second holding arm (22), wherein the first profile (101) of the platform assembly (10) comprises a first end section (1011) being arranged proximal to the first holding arm (21) and distal to the second holding arm (22), and a second end section (1012) being arranged proximal to the second holding arm (22) and distal to the first holding arm (21), wherein the first pivot pin (31) is fixed to the first end section (1011) of the first profile (101) of the platform assembly (10) and the second pivot pin (32) is fixed to the second end section (1012) of the first profile (101) of the platform assembly (10).

3. The wheelchair lift as claimed in claim 2, wherein the first profile (101) of the platform assembly (10) extends between the first and second holding arm (21, 22).

4. The wheelchair lift as claimed in claim 3, wherein each of the first and second pivot pin (31, 32) has a first portion (311, 321), a second portion (312, 322) and a third portion (313, 323), wherein the second portion (312, 322) is arranged between the first portion (311, 321) and third portion (313, 323), wherein the second portion (312, 322) of each of the first and second pivot pin (31, 32) has a larger diameter than the first and third portion (311, 321, 313, 323) of each of the first and second pivot pin (31, 32), wherein the first portion (311) of the first pivot pin (31) is pivotably coupled to the first holding arm (21) and the first portion (321) of the second pivot pin (32) is pivotably coupled to the second holding arm (22).

5. The wheelchair lift as claimed in claim 4, comprising:

a first bushing element (41) and a second bushing element (42), wherein the first bushing element (41) is arranged between the first holding arm (21) and the first portion (311) of the first pivot pin (31), wherein the second bushing element (42) is arranged between the second holding arm (22) and the first portion (321) of the second pivot pin (32).

6. The wheelchair lift as claimed in claim 4, wherein the third portion (313) of the first pivot pin (31) is formed with a thread (3130) to screw the third portion (313) of the first pivot pin (31) in the cavity (1013) of the first end section (1011) of the first profile (101) of the platform assembly (10), wherein the third portion (323) of the second pivot pin (32) is formed with a thread (3230) to screw the third portion (323) of the second pivot pin (32) in the cavity (1014) of the second end section (1012) of the first profile (101) of the platform assembly (10).

7. The wheelchair lift as claimed in claim 4, wherein the third portion (313) of the first pivot pin (11) is glued in the cavity (1013) of the first end section (1011) of the first profile (101) of the platform assembly (10), wherein the third portion (323) of the second pivot pin (32) is glued in the cavity (1014) of the second end section (1012) of the first profile (101) of the platform assembly (10).

8. The wheelchair lift as claimed in claim 4, wherein the platform assembly (10) comprises at least one plate (11) having a platform (110) to support the wheelchair and a first and second side panel (111, 112) respectively being arranged at different sides of the platform (110), wherein the first side panel (111) includes a hole (1110), wherein the first pivot pin (31) is inserted in the hole (1110) of the first side panel (111) such that the second portion (312) of the first pivot pin (31) is disposed in the hole (1110) of the first side panel (111), wherein the second side panel (112) includes a hole (1120), wherein the second pivot pin (32) is inserted in the hole (1120) of the second side panel (112) such that the second portion (322) of the second pivot pin (32) is disposed in the hole (1120) of the second side panel (122).

9. The wheelchair lift as claimed in claim 2, wherein the first and second end section (1011, 1012) of the first profile (101) of the platform assembly (10) respectively includes a cavity (1013, 1014), wherein the first pivot pin (31) is screwed in the cavity (1013) of the first end section (1011) of the first profile (101) of the platform assembly (10), wherein the second pivot pin (32) is screwed in the cavity (1014) of the second end section (112) of the first profile (101) of the platform assembly (10).

10. The wheelchair lift as claimed in claim 2, wherein the first and second end section (1011, 1012) of the first profile (101) of the platform assembly (10) respectively includes a cavity (1013, 1014), wherein the first pivot pin (31) is glued in the cavity (1013) of the first end section (1011) of the first profile (101) of the platform assembly (10), wherein the second pivot pin (32) is glued in the cavity (1014) of the second end section (1012) of the first profile (101) of the platform assembly (10).

11. The wheelchair lift as claimed in claim 1, wherein the platform assembly (10) comprises an inner plate (11) and an outer plate (12) to support the wheelchair and a hinge unit (13), wherein the inner plate (11) is pivotably coupled to the supporting assembly (20) by the coupling device (30) and the outer plate (12) is pivotably coupled to the inner plate (11) by the hinge unit (13), wherein the inner and outer plate (11, 12) respectively comprise a platform (110, 120), a first side panel (111, 121) and a second side panel (112, 122), wherein the respective platform (110, 120) is made of at least a second one of the plurality of profiles (102) of the platform assembly (10) made from aluminum, wherein the respective first side panel (111, 121) is made of at least a third one of the plurality of profiles (103) of the platform assembly (10) made from aluminum, wherein the respective second side panel (112, 122) is made of at least a fourth one of the plurality of profiles (104) of the platform assembly (10) made from aluminum, wherein the hinge unit (13) is made of at least a fifth one of the plurality of profiles (105) of the platform assembly (10) made from aluminum, wherein the platform (110) of the inner plate (11) has a first end (1101) distal to the hinge unit (13) and a second end (1102) proximal to the hinge unit (13), wherein the first profile (101) of the platform assembly (10) is disposed at the first end (1101) of the platform (110) of the inner plate (11) between the first and second side panels (111, 112) of the inner plate (11).

12. The wheelchair lift as claimed in claim 11, wherein the first and the second and the third and the fourth and the fifth of the plurality of profiles (101, 102, 103, 104, 105) of the platform assembly (10) are formed by an extrusion process or a laser cutting process.

13. The wheelchair lift as claimed in claim 11, comprising:

an elbow assembly (50) comprising a first and a second elbow device (51, 52) respectively comprising a first arm (511, 521) coupled to the inner plate (11), a second arm (512, 522) coupled to the supporting assembly (20), and a hinge element (513, 523) at which the respective first arm (511, 521) and the respective second arm (512, 522) are pivotably connected, another coupling device (60) comprising a first pivot pin (61) made from one of steel or high strength aluminum or titanium or magnesium or combinations thereof and a second pivot pin (62) made from one of steel or high strength aluminum or titanium or magnesium or combinations thereof, wherein the first pivot pin (61) of the other coupling device (60) is configured to pivotably couple the inner plate (11) to the first arm (511) of the first elbow device (51), wherein the second pivot pin (62) of the other coupling device (60) is configured to pivotably couple the inner plate (11) to the first arm (521) of the second elbow device (52), wherein the first pivot pin (61) of the other coupling device (60) is screwed in or glued on the first side panel (111) of the inner plate (11), wherein the second pivot pin (62) of the other coupling device (60) is screwed in or glued on the second side panel (112) of the inner plate (11).

14. The wheelchair lift as claimed in claim 13, comprising:

a first linkage device (71) being arranged between the platform assembly (10) and the first elbow device (51), a second linkage device (72) being arranged between the platform assembly (10) and the second elbow device (52), wherein the first and second side panel (111, 112) of the inner plate (11) respectively has an opening (1110, 1120), wherein the first linkage device (71) is guided from the first arm (511) of the first elbow device (51) through the opening (1110) of the first side panel (111) of the inner plate (11) inside the first side panel (111) of the inner plate (11) to the outer plate (12), wherein the second linkage device (72) is guided from the first arm (521) of the second elbow device (52) through the opening (1120) of the second side panel (112) of the inner plate (11) inside the second side panel (112) of the inner plate (11) to the outer plate (12).

15. The wheelchair lift as claimed in claim 1, comprising:

a power control assembly (80) to control a movement of the platform assembly (10), a lifting assembly (90) being connected to the power control assembly (80) and the supporting assembly (20) to lift and lower the supporting assembly (20), said lifting assembly (90) being made from aluminum, a mounting assembly (200) to mount the wheelchair lift on a floor, said mounting assembly (200) being made from aluminum.

* * * * *